US006322329B1

(12) United States Patent
Vera

(10) Patent No.: US 6,322,329 B1
(45) Date of Patent: Nov. 27, 2001

(54) HYDRAULIC PUMP OF THE GEAR TYPE AND ELECTRO-PUMP EQUIPPED WITH SUCH A PUMP

(75) Inventor: Christiano Vera, Marcoussis (FR)

(73) Assignee: Hydroperfect International, Chennevieres sur Marne (FR)

( * ) Notice: Subject to any disclaimer, the term of this patent is extended or adjusted under 35 U.S.C. 154(b) by 0 days.

(21) Appl. No.: 09/497,485

(22) Filed: Feb. 4, 2000

(30) Foreign Application Priority Data

Feb. 4, 1999 (FR) ..... 99 01317

(51) Int. Cl.[7] ..... F01C 1/18
(52) U.S. Cl. ..... 417/313; 417/410.4; 418/206.1
(58) Field of Search ..... 417/410.4, 313; 418/206.1

(56) References Cited

U.S. PATENT DOCUMENTS

| | | | | |
|---|---|---|---|---|
| 1,944,340 | | 1/1934 | Zubaty et al. . | |
| 4,134,549 | * | 1/1979 | Perr | 239/92 |
| 4,324,276 | * | 4/1982 | Kemner | 138/30 |
| 4,355,964 | * | 10/1982 | Rodibaugh et al. | 418/206.1 |
| 6,048,187 | * | 4/2000 | Hamasaki et al. | 418/206.1 |
| 6,158,983 | * | 12/2000 | Harpole et al. | 417/410.5 |

FOREIGN PATENT DOCUMENTS

| | | |
|---|---|---|
| 657185 | 2/1938 | (DE) . |
| 2832299 | 1/1980 | (DE) . |
| 3014280 | 10/1981 | (DE) . |
| 4025910 | 6/1991 | (DE) . |
| 19816173 | 10/1998 | (DE) . |
| 7210465 | 10/1972 | (FR) . |
| 481084 | 3/1938 | (GB) . |
| 987587 | 3/1965 | (GB) . |
| 2220035 | 3/1989 | (GB) . |

* cited by examiner

*Primary Examiner*—Charles G. Freay
*Assistant Examiner*—David J. Torrente
(74) *Attorney, Agent, or Firm*—Browdy and Neimark

(57) ABSTRACT

The hydraulic pump, in particular the hydraulic pump of an electro-pump unit, of a type comprising a pump body enclosing a gear pump and provided with a suction aperture for aspirating a low pressure liquid and an outlet chamber for driving back a high pressure liquid, which communicates with a high pressure outlet channel connected to a user hydraulic circuit, and a hydraulic capacity for dampening of pulses generated by the pump and equipped with deaerating means for a draining of air able to be trapped therein, the deaerating means being formed by the high pressure liquid that is driven by the pump back into the outlet channel.

11 Claims, 4 Drawing Sheets

HYDRAULIC PUMP OF THE GEAR TYPE AND ELECTRO-PUMP EQUIPPED WITH SUCH A PUMP

FIELD OF THE INVENTION

This invention relates to a hydraulic pump, in particular a hydraulic pump of an electro-pump unit, of a type comprising a pump body enclosing a gear pump and provided with a suction aperture for aspirating a low pressure liquid and an outlet chamber which communicates with an outlet channel for driving back a high pressure liquid, connected to a user hydraulic circuit, and a hydraulic capacity for a dampening of pulses that are generated by the pump and equipped with deaerating means for a draining of the air able to be trapped therein. The invention relates also to an electro-pump unit equipped with a pump according to the invention.

BACKGROUND OF THE INVENTION

Hydraulic pumps of the above type are already known, in which the deaerating means are formed as a valve which enables the trapped air to be drained into a low pressure liquid tank surrounding the capacity. This solution has the drawback that it implies establishement of a low pressure communication between the capacity and the tank, which can in case cause in particular an air suction effect toward the capacity when a level of the liquid in the tank is under a level of the valve.

PURPOSE AND SUMMARY OF THE INVENTION

The invention has for its purpose to cope with the above drawback.

To reach this purpose, the hydraulic pump according to the invention is characterized in that the aerating means are formed by the high pressure liquid driven by the pump back into the outlet channel.

According to another feature of the invention, the hydraulic capacity is serially arranged in the flow path of the high pressure liquid, whereby the air which is stored in the capacity will be expelled by the driven back liquid.

According to another feature of the invention, the hydraulic capacity is above the driving back chamber and an aerating tube is extended from top of the hydraulic capacity to the driving back channel.

According to still another feature of the invention, the high pressure outlet is provided in an interface block between the pump and the driving motor thereof.

According to still another feature of the invention, the hydraulic capacity is formed by a dome shaped cover arranged directly on the upper face of the pump body so that the lower face of the cover will close the pump body with insertion of sealing gaskets in the contacting faces of the cover and pump body.

BRIEF DESCRIPTION OF THE DRAWINGS

Further advantages, features and details of the invention will be apparent from the following description of a preferred embodiment taken only as an example with reference to the drawings showing diagrammatic views, in which.

DETAILED DESCRIPTION OF THE PREFERRED EMBODIMENT

Figure 1:
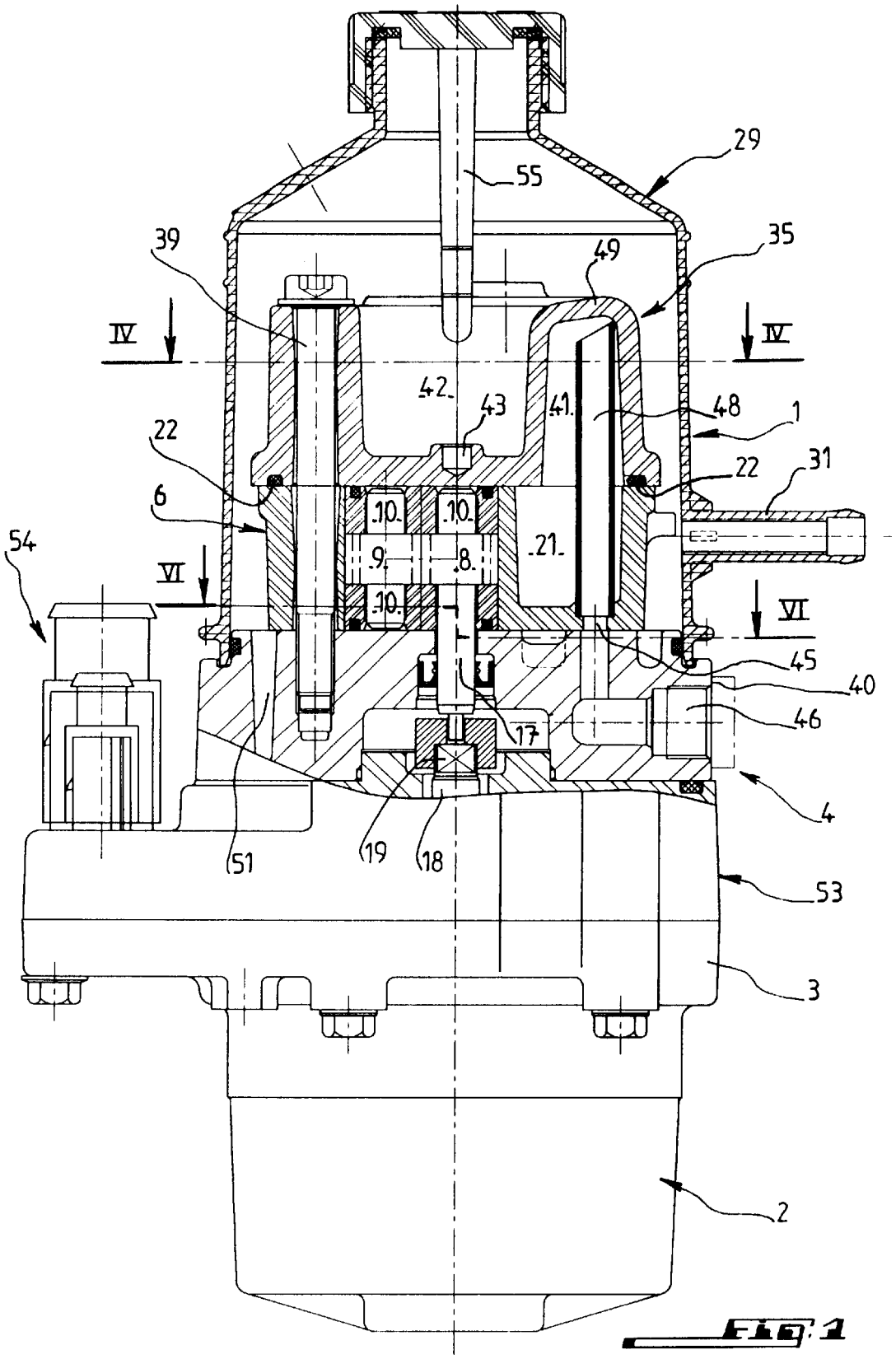
FIG. 1 is an axial view partially in cross section taken along line I—I of FIG. 2.

Referring now to the drawings, the invention will be hereinafter described, as an example, in the application thereof to an electro-pump unit. In FIG. 1, the pump is shown at 1 and the electric motor that is designed to drive the pump is shown at 2. The pump 1 is of the gear type. The pump 1 is mounted on a connecting flange 3 of the motor 2 by means of an interface 4.

The pump 1 comprises a pump central body 6 provided with a cavity having an egg-shaped cross section 7 (FIG. 5) in which are rotatively mounted two pinions 8 and 9 of the gear pump 2 by means of bearings shown at 10. The pinions 8 and 9 mesh together. One of the pinions, which is the pinion 8, is provided with a driving shaft 10 and is rotatively driven by a motor shaft 18 of the motor 2 by means of a coupling arrangement 19.

Figure 5:
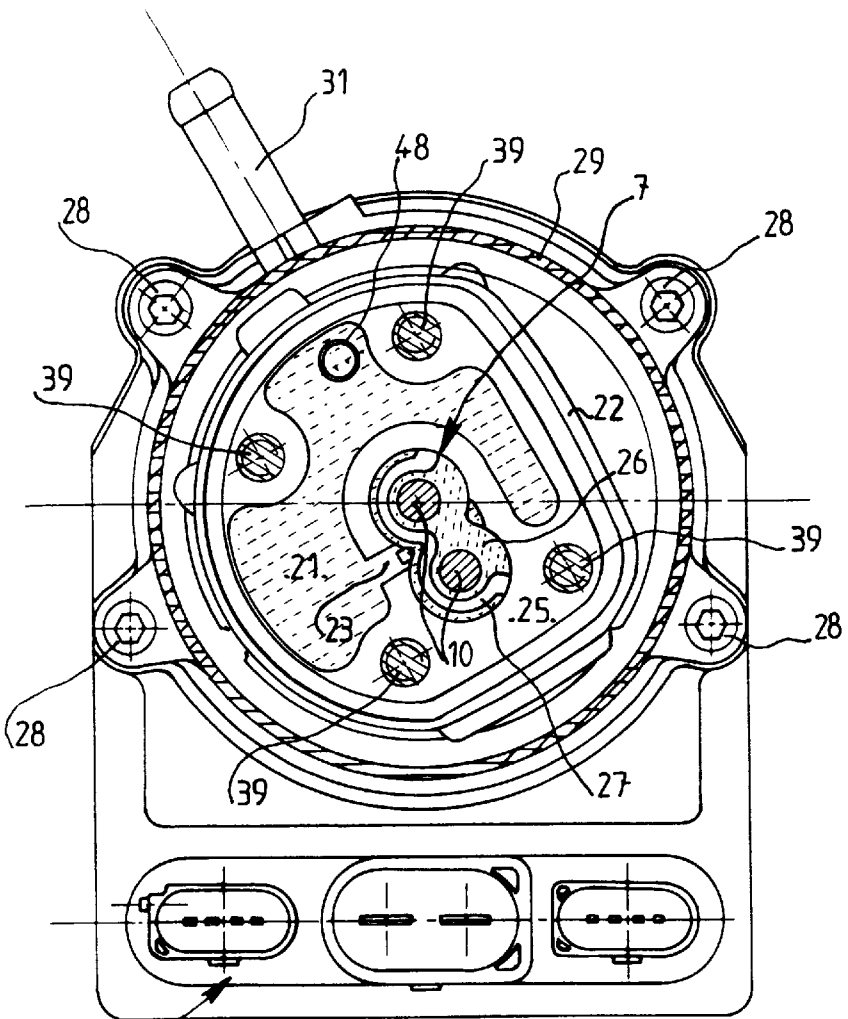
FIG. 5 is a section view taken along line V—V of FIG. 3.

As shown in FIG. 5, the pump central body 6 further comprises a cavity 21 which extends between the cavity 7 for housing the pinions 8 and 9 and a peripheral sealing gasket 22. The cavity 21 surrounds a greater portion of the cavity 7. The cavity 21 is shown in FIG. 5 by a zone that is distinguished by small dashes. This zone is connected to the cavity 7 of the pump 1 by means of a pump outlet high pressure passage 23 and constitutes therefore the high pressure zone of the pump 1. The portions, remaining white and shown at 25 in FIG. 5, of the pump central body 6 constitute the plane upper face of the body. The zone 26 of the central egg-shaped cavity 7, which is distinguished by small dots, constitutes the low pressure zone of the pump. A sealing gasket 27 isolates the zone 26 from the high pressure zone at the outlet high pressure passage 23.

The pump body 6 is enclosed in a jacket 29 which is fixed at 28, in a seal tight manner, to the periphery of the interface 4. The jacket 29 delimits a low pressure liquid tank and communicates with the user circuit by means of an inlet connector 31. As shown in particular in FIG. 3, the pump 1 aspirates a liquid from the tank 32 through a suction canal 33 and drives the high pressure liquid through the outlet high pressure passage 23 back into the cavity 21.

Figure 4:
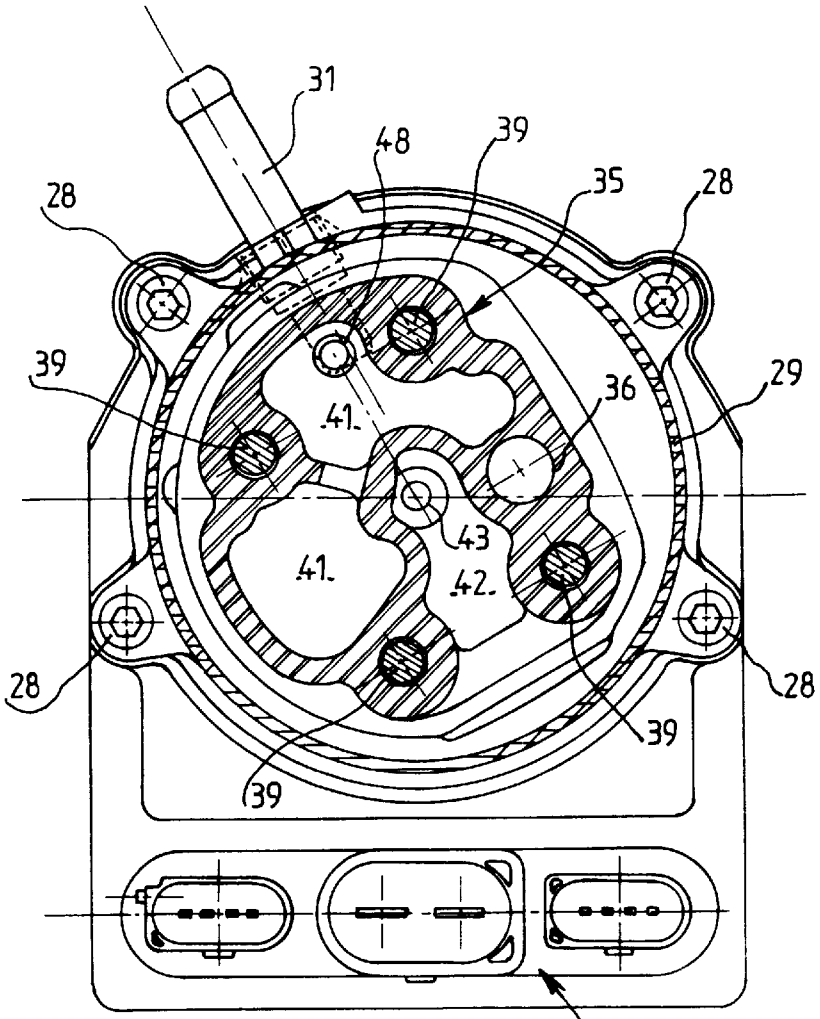
FIG. 4 is a section view taken along line IV—IV of FIG. 2.

A dome shaped cover 3 is directly fixed onto the upper plane face 25 of the pump body 6, which dome shaped cover 3 delimits a dampening capacity for the pulses that are generated upon the working of the pump 1, and further houses a pressure limiting device 36 and a re-feeding valve 37. The cover 3 has a periphery that is crossed through by four tie-rods 39 which also extend through the pump central body 6 and are screwed in a block 40 for supporting the interface 4. FIG. 4 shows the dampening capacity formed by an inner space 41. It is also shown that the cover 3 has a radially depressed zone 42 which extends from the periphery up to the center which is shaped as a hole 43 for centering the cover 3.

By referring to FIGS. 1, 4 and 5, it is found that the dampening capacity inner space 41 o f the cover 3 communicates with the high pressure capacity 21 of the pump central body 6. The shapes of the cover and cavity space are in a matching correspondence at the contacting faces of the cavity and pump body, the sealing gaskets 22 and 27 being inserted between these two contacting faces, the sealing gasket 22 being supported by the cover 3.

As shown in FIG. 1, the bottom of the high pressure cavity 21 is bored at 45 and opens in a vertical channel made in the support block 40 for supporting the pump-motor interface 4 and which opens in a high pressure outlet channel 46 that itself opens outwardly at the periphery of the support block 40.

According to an essential feature of the invention, a deaerating tube 48 is extended in the common inner space formed by the cavity space 41 and cavity 21, vertically from a place near the top wall 49 of the cover 35 to the bore 45. Thanks to the deaerating tube 48, a liquid which is driven back by the pump must, for coming to the high pressure outlet 48, rise from the high pressure cavity 21 into the space 41 of the hydraulic cavity to the inlet of the tube 48, so to thereafter fall in the tube 48. Thus, the cavity 21 and cavity 41 are serially mounted in the flow path of the high pressure liquid, and the air that is trapped in the cavity will be expelled or driven by the high pressure liquid out of the pump 1. The deaerating tube 48 provides therefore an effective deaeration of the dampening hydraulic capacity.

Figure 6:
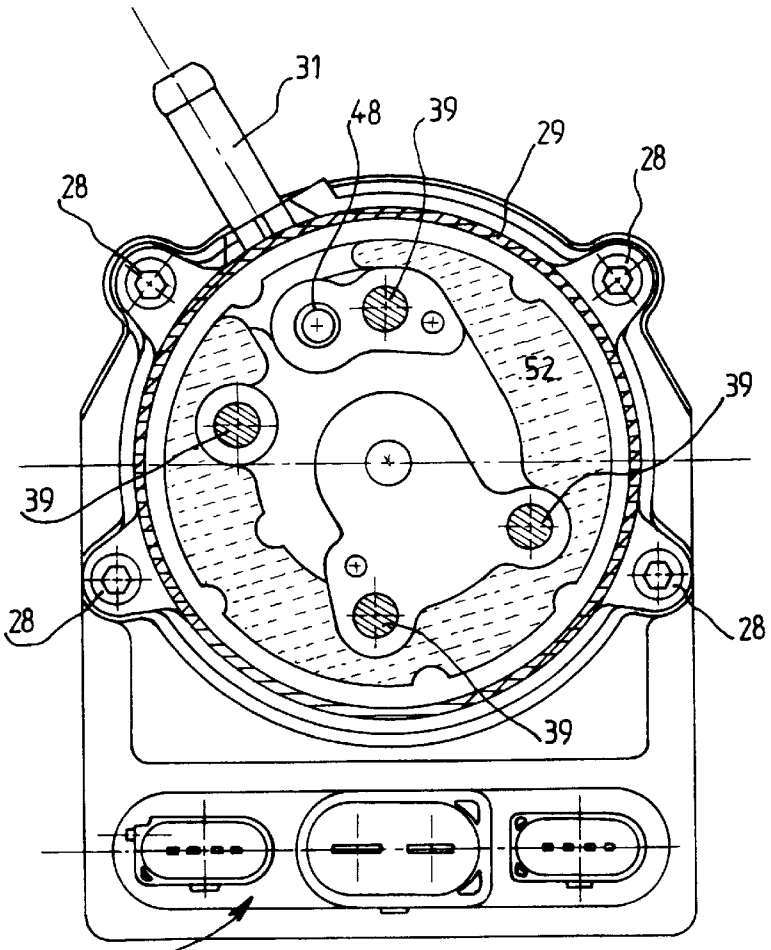
FIG. 6 is a section view taken along line VI—VI of FIG. 1.
Figure 2:
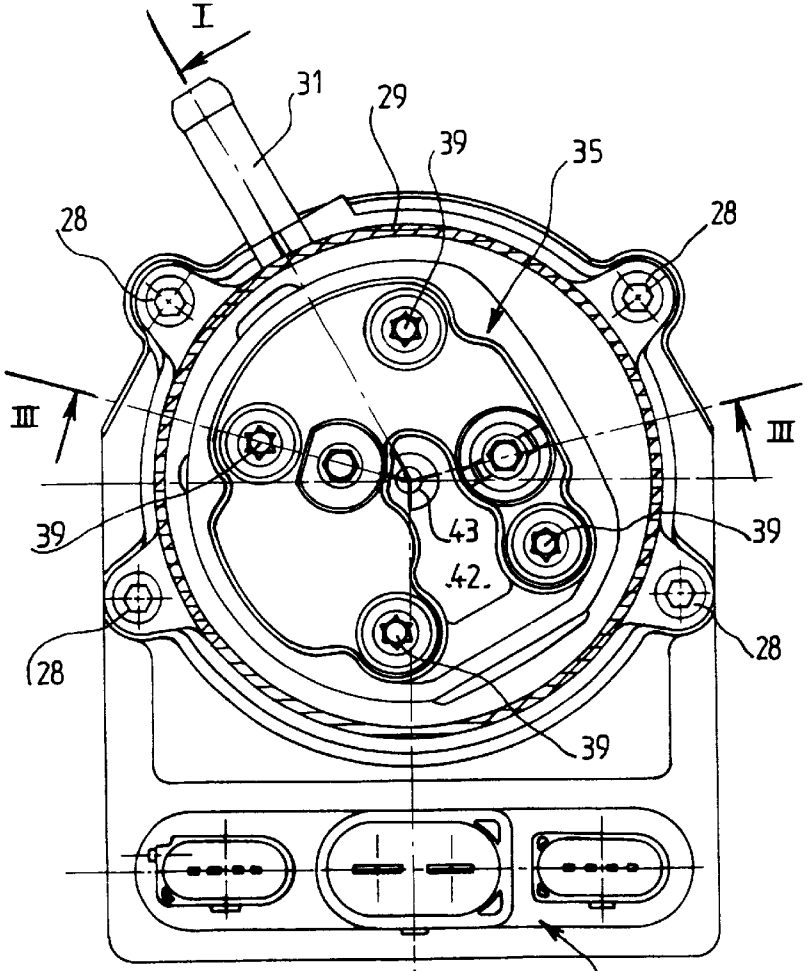
FIG. 2 is a section view taken along line II—II of FIG. 3.
Figure 3:
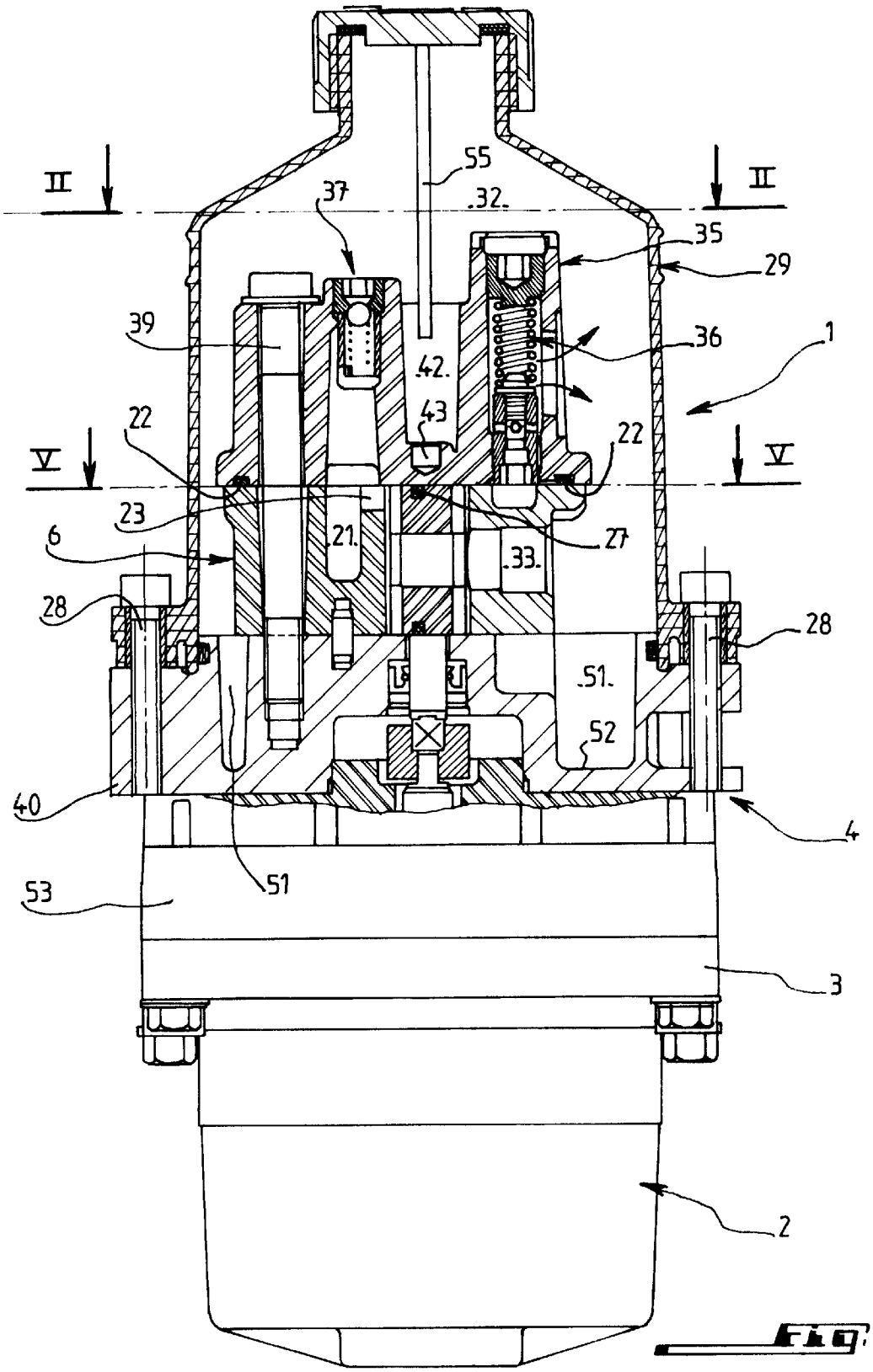
FIG. 3 is a section view taken along line III—III of FIG. 2.

By now referring in particular to FIGS. 3 and 4, it is further shown that the support block 40 comprises an important cavity 51 which extends practically on all its periphery, communicates with a tank 32 and has a bottom 52 shown by dots in FIG. 6 which forms an important heat exchange surface enabling to effectively evacuate the calories generated by the electronic controller for piloting the motor 2 housed in an interface portion 53 placed between the support block 40 and the motor flange 3, and the outer electric connecting device of which is shown at 54.

It should be noted that the pressure limiting device which is integrated to the cover and is of a conventionnal configuration is inserted between the high pressure part of the pump and the tank by opening therein as shown by arrows. A gauge for taking the level of the liquid in the tank is further shown at 55.

It results from the above description of the electro-pump unit structure which is shown in the drawings, that the invention provides a solution which is both simple and effective to the problem raised by possible residual air in the pump dampening capacity. Another important advantage of the invention is in the fact that this dampening capacity is carried into effect as a dome shaped cover which is directly fixed onto the upper face of the pump central body, without any insertion of a specific interface device. This feature of the invention and the fact that the high pressure cavity is arranged around the central housing part of the pump pinions enables to obtain a structure which is both simple and compact, and therefore not very bulky. Thus, the size of the electro-pump unit according to the invention is relativelly small. Lastly, the important cavity in the support block for supporting the interface which communicates with the tank provided an effective evacuation of the calories generated by the electronic controller for piloting the motor.

What is claimed is:

1. A hydraulic pump, in particular a hydraulic pump of an electro-pump unit, of a type comprising a pump body enclosing a gear pump and provided with a suction aperture for aspirating a low pressure liquid and an outlet chamber for driving back a high pressure liquid, which communicates with a high pressure outlet channel connected to a user hydraulic circuit, and a hydraulic capacity for dampening of pulses generated by said pump and equipped with deaerating means for a draining of air able to be trapped therein, wherein said deaerating means receives said high pressure liquid driven by said pump (1) into said outlet channel (45, 46).

2. The hydraulic pump as set forth in claim 1, wherein said hydraulic capacity (41) is serially arranged in the flow path of said high pressure liquid out of said pump, wherein air stored in said cavity will be expelled by said driven back liquid.

3. The hydraulic pump as set forth in claim 1, wherein said hydraulic capacity (41) is above said outlet chamber (21) and wherein an aerating tube (48) is extended from top of said hydraulic capacity to said outlet channel (45, 46).

4. The hydraulic pump according to claim 1, wherein said hydraulic capacity (41) is formed with an upper face (25 and a lower face, and wherein said hydraulic capacity (41) is formed by a cover (3) directly arranged on said upper face (25) of said pump body (6), whereby said lower face of said cover is provided to close said pump body, with an insertion of sealing gaskets (22, 27) in contacting faces of said cover (35) and pump body (6).

5. The hydraulic pump as set forth in claim 1, wherein said pump is provided with a part for housing pinions (8, 9), and wherein said high pressure outlet chamber (21) is provided in said pump body (6) around said part for housing said pinions (8, 9).

6. The hydraulic pump as set forth in claim 4, wherein a pressure limiting device (36) is mounted in said cover (35).

7. The hydraulic pump as set forth in claim 4, wherein a re-feeding valve (37) is mounted in said cover (38).

8. The hydraulic pump as set forth in claim 4, wherein said cover comprises a central depressed zone, with said depressed zone being provided with a hole (43) for centering said cover.

9. An electro-pump unit comprising a gear pump, an electric motor for driving said pump and an interface between said motor and pump, comprising a block for supporting said pump, wherein said electro-pump comprises a hydraulic pump (1) as set forth in claim 1.

10. The electro-pump unit as set forth in claim 9, wherein the high pressure outlet (46) of said pump is provided in said interface supporting block (40), a bore (45) made in a bottom of said pump body (6) connecting said high pressure outlet chamber (21) to said outlet channel (46).

11. The electro-pump unit as set forth in claim 9, wherein said pump body and cover are enclosed in an outer jacket that is fixed onto said interface supporting block and forms a low pressure liquid tank, wherein said interface supporting block comprises a cavity (51) communicating with said tank (32) and having a bottom (52) that forms a heat exchange surface for evacuating calories generated by an electronic controller for piloting said motor housed in an interface portion (53) beneath said interface supporting block (40).

* * * * *